US012604983B2

(12) United States Patent
Fraser

(10) Patent No.: US 12,604,983 B2
(45) Date of Patent: Apr. 21, 2026

(54) COLLAPSIBLE CHAIR

(71) Applicant: Mark Andrew Fraser, Brisbane (AU)

(72) Inventor: Mark Andrew Fraser, Brisbane (AU)

( * ) Notice: Subject to any disclaimer, the term of this patent is extended or adjusted under 35 U.S.C. 154(b) by 189 days.

(21) Appl. No.: 17/300,334

(22) Filed: Jun. 4, 2021

(65) Prior Publication Data

US 2024/0285078 A1 Aug. 29, 2024

Related U.S. Application Data

(63) Continuation-in-part of application No. PCT/AU2019/051320, filed on Dec. 4, 2019.

(30) Foreign Application Priority Data

Dec. 4, 2018 (AU) ..... 2018904599

(51) Int. Cl.

| | |
|---|---|
| ***A47C 1/14*** | (2006.01) |
| ***A47C 1/027*** | (2006.01) |
| ***A47C 1/034*** | (2006.01) |
| ***A47C 1/036*** | (2006.01) |
| ***A47C 4/28*** | (2006.01) |
| ***A47C 4/30*** | (2006.01) |
| ***A47C 4/42*** | (2006.01) |
| ***A47C 4/46*** | (2006.01) |
| ***A47C 5/06*** | (2006.01) |
| ***A47C 5/10*** | (2006.01) |

(Continued)

(52) U.S. Cl.

CPC ..... *A47C 5/10* (2013.01); *A47C 1/027* (2013.01); *A47C 1/034* (2013.01); *A47C 1/036* (2013.01); *A47C 1/143* (2013.01); *A47C 4/28* (2013.01); *A47C 4/30* (2013.01); *A47C 4/42* (2013.01); *A47C 4/46* (2013.01); *A47C 5/06* (2013.01); *A47C 7/506* (2013.01); *A47C 7/622* (2018.08)

(58) Field of Classification Search

CPC ..... A47C 1/034; A47C 1/027; A47C 1/036; A47C 1/143; A47C 4/30; A47C 7/622

See application file for complete search history.

(56) References Cited

U.S. PATENT DOCUMENTS

| | | | |
|---|---|---|---|
| 335,554 | A | 2/1886 | Anderson |
| 424,952 | A | 4/1890 | Blum |
| 564,253 | A | 7/1896 | McCaffrey |

(Continued)

FOREIGN PATENT DOCUMENTS

| | | |
|---|---|---|
| AU | 1740383 A | 2/1984 |
| CH | 307584 | 8/1955 |

(Continued)

OTHER PUBLICATIONS

Australia Examination Report No. 1 for Application No. 2021103158, dated Aug. 24, 2021, 9 pages.

(Continued)

*Primary Examiner* — Philip F Gabler

(74) *Attorney, Agent, or Firm* — Brooks Kushman P.C.

(57) ABSTRACT

The present invention relates to a collapsible chair. The chair includes a backrest for engaging with a sitter's back. A seat extends from the backrest and is where the sitter can sit. A retractable leg support may extend from the seat and can be extended to support the sitter's legs with feet off the ground. Advantageously, the sitter's feet may be safely off the ground away from ants and sand.

18 Claims, 8 Drawing Sheets

(51) Int. Cl.
*A47C 7/50* (2006.01)
*A47C 7/62* (2006.01)

(56) References Cited

U.S. PATENT DOCUMENTS

| | | | | |
|---|---|---|---|---|
| 709,688 | A | 9/1902 | Vogel | |
| 1,251,079 | A * | 12/1917 | Mester | A47C 1/143 297/19 |
| 3,006,685 | A | 10/1961 | Ewert | |
| 3,186,757 | A | 6/1965 | Hopkins | |
| 3,338,625 | A | 8/1967 | Jung-Shien | |
| 4,076,303 | A | 2/1978 | Korenblit | |
| 4,265,481 | A | 5/1981 | Fleischer | |
| 4,273,380 | A | 6/1981 | Silvestri | |
| 4,441,756 | A | 4/1984 | Liou et al. | |
| 4,536,028 | A | 8/1985 | Jones et al. | |
| 4,635,667 | A | 1/1987 | Harn | |
| 4,773,708 | A | 9/1988 | Nastu | |
| 4,801,176 | A * | 1/1989 | Wolberg | A47C 4/286 5/116 |
| 4,838,608 | A | 6/1989 | Hansen-Smith et al. | |
| 4,921,301 | A | 5/1990 | Haynes | |
| 4,955,517 | A | 9/1990 | Maresca | |
| 5,582,458 | A | 12/1996 | Wildt | |
| 5,597,210 | A | 1/1997 | Pickard | |
| 5,950,259 | A | 9/1999 | Boggs | |
| 6,113,181 | A * | 9/2000 | Tang | A47C 7/506 297/27 |
| 6,250,712 | B1 * | 6/2001 | Livington | A47C 1/146 5/632 |
| 6,325,455 | B1 | 12/2001 | Chung | |
| 6,382,727 | B1 | 5/2002 | Pickard | |
| 6,692,068 | B1 | 2/2004 | Tang | |
| 6,755,463 | B2 * | 6/2004 | Lardieri | A47C 1/03 297/423.36 |
| 6,817,671 | B1 | 11/2004 | Zheng | |
| 6,843,527 | B2 | 1/2005 | Nelson et al. | |
| 6,938,287 | B1 | 9/2005 | Mahshie | |
| 7,195,310 | B2 * | 3/2007 | Reese | A47C 7/52 297/27 |
| 7,628,450 | B2 | 12/2009 | Castagnola et al. | |
| 7,959,222 | B1 * | 6/2011 | Powell | A47C 20/026 5/725 |
| 8,668,268 | B1 | 3/2014 | Cormack | |
| 8,708,406 | B1 | 4/2014 | Powell et al. | |
| 8,794,698 | B2 | 8/2014 | Halsey | |
| 8,794,699 | B1 | 8/2014 | Rudolfo | |
| 8,905,471 | B2 | 12/2014 | Tang | |
| 10,765,213 | B2 | 9/2020 | Pernet et al. | |
| 10,980,347 | B1 | 4/2021 | Levin | |
| 2005/0264049 | A1 | 12/2005 | Fleites | |
| 2006/0001295 | A1 | 1/2006 | Reese | |
| 2006/0061146 | A1 | 3/2006 | Grace | |
| 2006/0071513 | A1 * | 4/2006 | Pedemonte | A47C 1/143 297/16.1 |
| 2009/0021057 | A1 | 1/2009 | Erb et al. | |
| 2013/0214565 | A1 | 8/2013 | Nickell | |
| 2014/0097599 | A1 | 4/2014 | Panigot | |
| 2014/0132041 | A1 | 5/2014 | Manus | |
| 2014/0183909 | A1 | 7/2014 | Smith | |
| 2015/0042144 | A1 | 2/2015 | Frankel et al. | |
| 2015/0137566 | A1 * | 5/2015 | Wagner | A47C 4/283 297/180.12 |
| 2015/0366357 | A1 | 12/2015 | Nelson | |
| 2018/0249836 | A1 * | 9/2018 | Wise | A47C 7/666 |
| 2022/0295997 | A1 | 9/2022 | Moore | |

FOREIGN PATENT DOCUMENTS

| | | | |
|---|---|---|---|
| CN | 208030722 | U | 11/2018 |
| GB | 2331233 | A | 5/1999 |
| JP | 2000287777 | A | 10/2000 |
| JP | 2016093475 | A | 5/2016 |
| WO | 9009749 | A1 | 9/1990 |
| WO | 9118540 | A1 | 12/1991 |
| WO | 9837791 | A1 | 9/1998 |

OTHER PUBLICATIONS

Australia Examination Report No. 2 for Application No. 2021203740, dated Nov. 16, 2022, 4 pages.

Australia Examination Report No. 3 for Application No. 2021203740, dated Feb. 27, 2023, 6 pages.

International Search Report and Written Opinion for Application No. PCT/AU2019/051320, dated Dec. 23, 2019, 5 pages.

* cited by examiner

COLLAPSIBLE CHAIR

TECHNICAL FIELD

The present invention relates to a collapsible chair. The present invention has particular, although not exclusive use for beach and camping activities.

BACKGROUND

The reference to any prior art in this specification is not, and should not be taken as an acknowledgement or any form of suggestion that the prior art forms part of the common general knowledge.

Collapsible chairs for beach and camping activities are known. However, in practice, the sitter's feet resting on the ground are often undesirably subjected to ants and sand. The preferred embodiment impedes exposure of the feet to ants and sand.

Further, collapsible chairs are often heavy and unwieldy when collapsed. The preferred embodiment provides for a compact collapsed chair.

SUMMARY OF THE INVENTION

According to one aspect of the present invention, there is provided a collapsible chair including:

a backrest for engaging with a sitter's back; and a seat extending from the backrest and upon which the sitter can sit.

The chair may further include a retractable head support for supporting a sitter's head. The head support may be pivotally mounted to the backrest. The chair may further include a recline adjuster to adjust the recline of the backrest. The recline adjuster may include a slider for sliding along the seat; and a tether for tethering between the slider and the backrest. The recline adjuster may include a lock for locking the slider in place. The lock may include a tongue in groove arrangement. The lock may be rotatably actuated.

The chair may include a retractable leg support extending from the seat and which can be extended to support the sitter's legs with feet off the ground. Advantageously, the sitter's feet are safely off the ground away from ants and sand. However, the retractable leg support may also be retracted so that the sitter's feet engage the ground for a different sitting position.

The retractable leg support may include a pivoting frame. The retractable leg support may include a sheet. The sheet may be fastened between a chair frame and the pivoting frame. The sheet may include fabric. The sheet may be limp. The sheet may terminate in collars collaring frame elements of the chair frame and the pivoting frame. The sheet may include a pocket for receiving the pivoting frame.

The chair may include a chair frame. The chair frame may include frame elements that nest together so that the collapsed chair frame is the compact thickness of a frame element. The thickness may be about 6 cm. The folded chair may be about 50 cm×60 cm. The chair may weigh less than 2 kg.

The chair frame may include a backrest frame and a rear spur frame pivotally mounted to the backrest frame. The chair frame may include a seat frame pivotally mounted to the backrest frame. The chair frame may include a front spur frame pivotally mounted to the seat frame.

The chair may include one or more sheet supports for mounting to the chair frame to support the sitter. The sheet supports may include one or more cutouts to facilitate frame folding.

The chair may include a storage area at the rear of the backrest. The storage area may include a shelf.

According to another aspect of the present invention, there is provided a collapsible chair including:

a seat upon which the sitter can sit; and a retractable leg support extending from the seat and which can be extended to support the sitter's legs with feet off the ground.

Any of the features described herein can be combined in any combination with any one or more of the other features described herein within the scope of the invention.

BRIEF DESCRIPTION OF THE DRAWINGS

Preferred features, embodiments and variations of the invention may be discerned from the following Detailed Description which provides sufficient information for those skilled in the art to perform the invention. The Detailed Description is not to be regarded as limiting the scope of the preceding Summary of the Invention in any way. The Detailed Description will make reference to a number of drawings as follows.

DETAILED DESCRIPTION OF PREFERRED EMBODIMENTS

Figure 1:
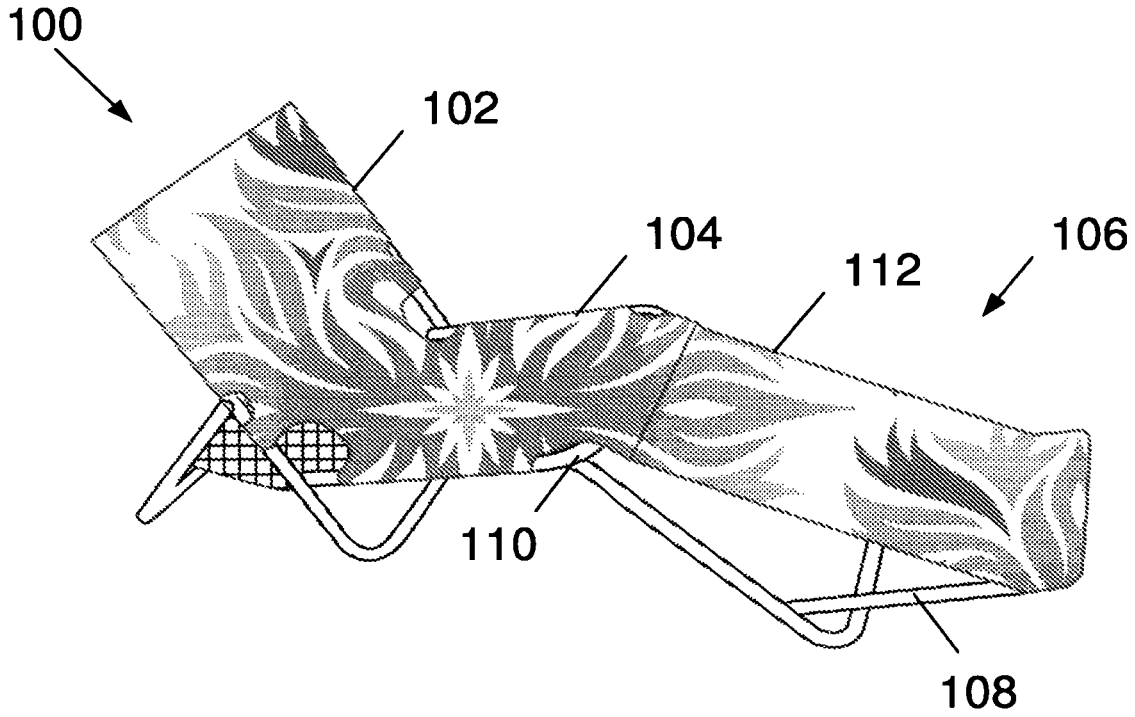
FIG. 1 is a perspective view of a collapsible beach chair with extended leg support in accordance with an embodiment of the present invention.
Figure 2:
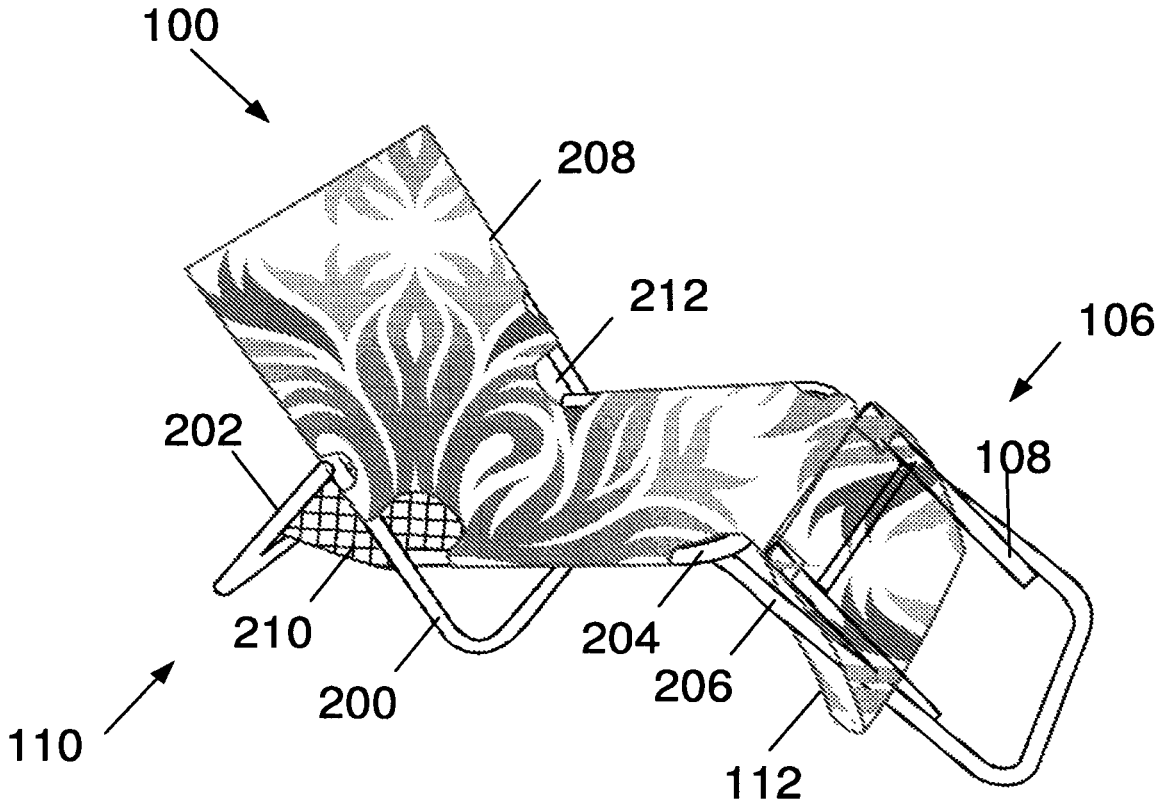
FIG. 2 is a perspective view of the collapsible beach chair of FIG. 1 with retracted leg support.

According to one aspect of the present invention, there is provided a collapsible beach chair 100 which can be configured in a lounge configuration as shown in FIG. 1 and a seated chair position as shown in FIG. 2.

Turning to FIG. 1, the chair 100 includes a backrest 102 for engaging with a sitter's back. A seat 104, upon which the sitter can sit, extends from the backrest 102. A retractable leg support 106 extends from the seat 104. The leg support 106 can be extended to support the sitter's legs with feet off the ground. Advantageously, the sitter's feet are safely off the ground away from ants and sand.

The retractable leg support 106 includes a U-shaped legrest endframe 108 which pivots from a main chair frame 110. The retractable leg support 106 includes a limp fabric sheet 112 fastened between the chair frame 110 and the pivoting endframe 108. Typically, ends of the sheet 112 terminate in collars collaring parallel frame elements of the chair frame 110 and the pivoting frame 108. The free end of the sheet 112 also includes a pocket for receiving and covering the free end the pivoting frame 108.

Turning to FIG. 2, the retractable leg support 106 can also be retracted so that the sitter's feet engage the ground in a different upright position.

The chair frame 110 includes an inclined rectangular backrest frame 200 and a rear U-shaped spur frame 202 pivotally mounted to the backrest frame 200. The chair frame 110 also includes a U-shaped seat frame 204 pivotally mounted to the backrest frame 200. The chair frame 110 also includes a front U-shaped spur frame 206 pivotally mounted to the seat frame 204.

The chair 100 also includes one or more fabric sheet supports 208 for mounting to cover the chair frame 110 to support the sitter. The sheet supports 208 include lateral cutouts 212, about the pivot, to facilitate frame folding. The sheet supports 208 are also stitched to the legrest sheet 112. The fabric sheet supports 208 connect to the chair frame 110 using column mounts.

The chair 100 also includes a storage area at the rear of the backrest 102 defined by a fabric shelf 210 extending between the rear spur frame 202 and the backrest frame 200.

Figure 3:
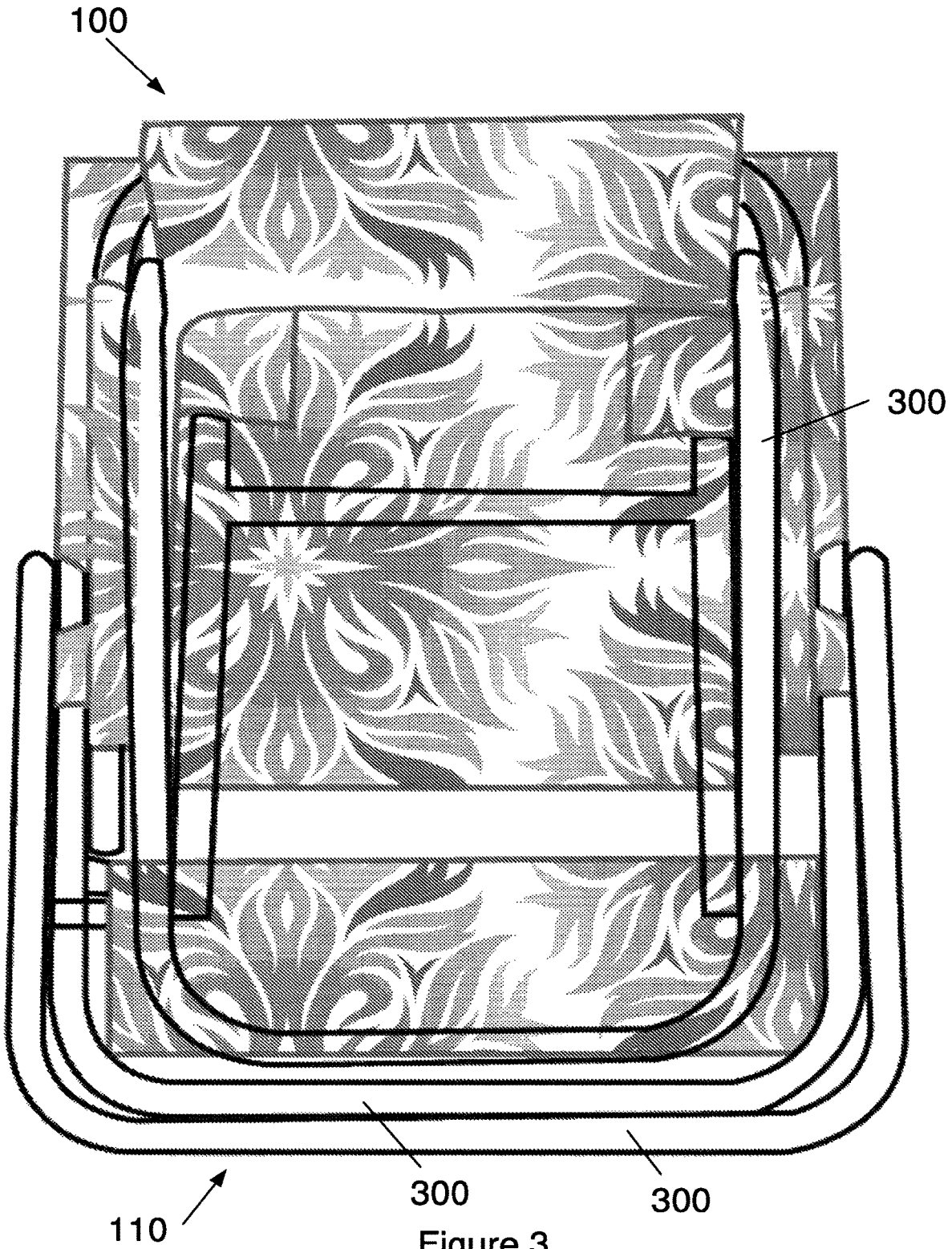
FIG. 3 is a plan view of the collapsed beach chair of FIG. 1.

Turning to FIG. 3, the chair frame 110 (including the legrest frame 108) is typically formed from bent tubular aluminum frame elements 300 that nest together so that the collapsed chair frame 110 is the compact thickness of a single frame element 300. The overall collapsed thickness is about 6 cm which is extremely slimline. The overall folded chair 100 is about 50 cm×60 cm. The chair 100 weighs less than 2 kg thereby making it extremely easy to handle and store. Accordingly, the compact chair 110 is also well suited to apartment living.

Figure 4:
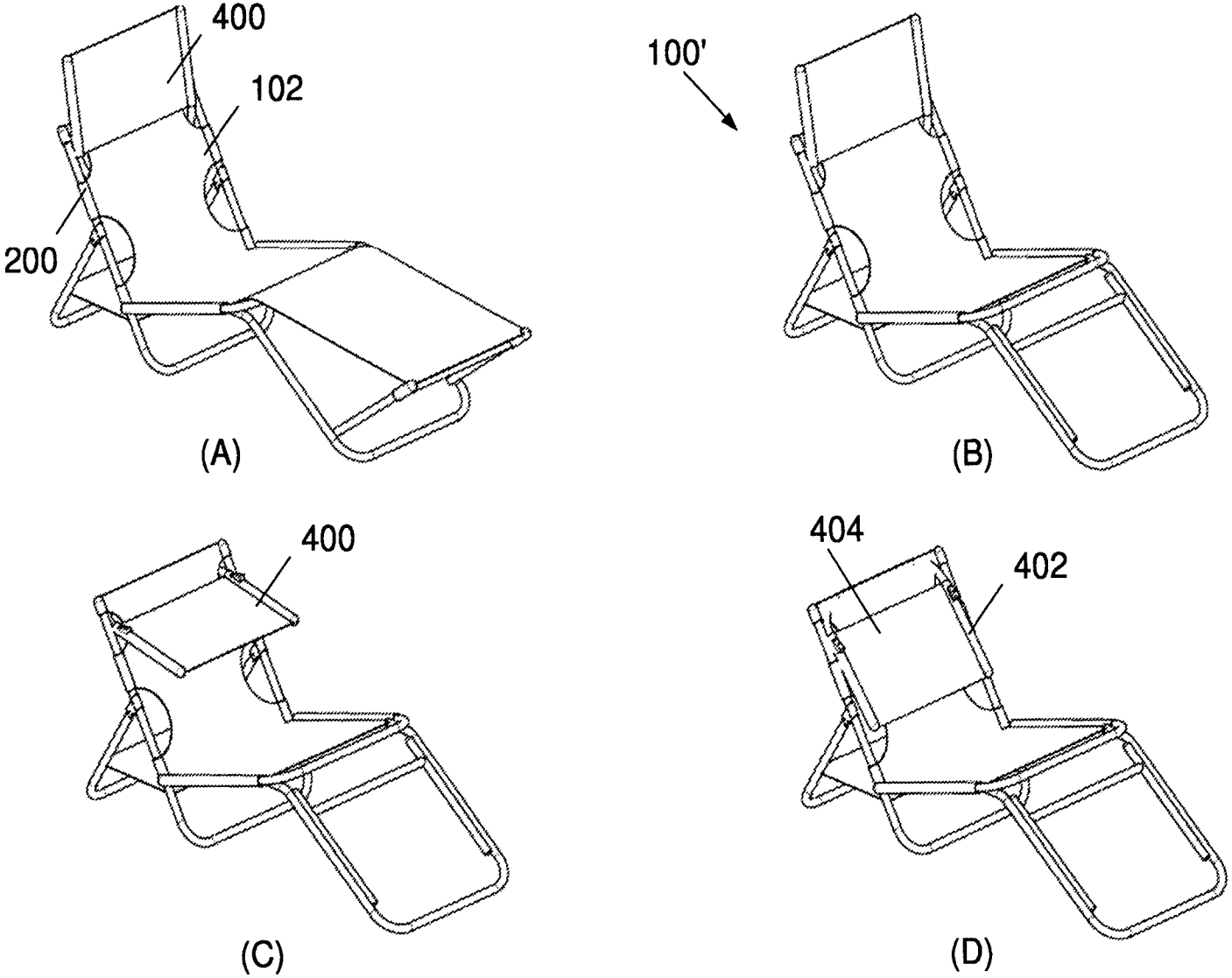
FIG. 4 shows the collapsible beach chair of FIG. 1 with a retractable headrest.

FIG. 4 shows the collapsible beach chair 100' of FIG. 1, but with a retractable headrest 400 (i.e. support) for supporting a sitter's head. The headrest 400 includes a headrest frame 402 between which a sheet 404 extends.

Figure 5:
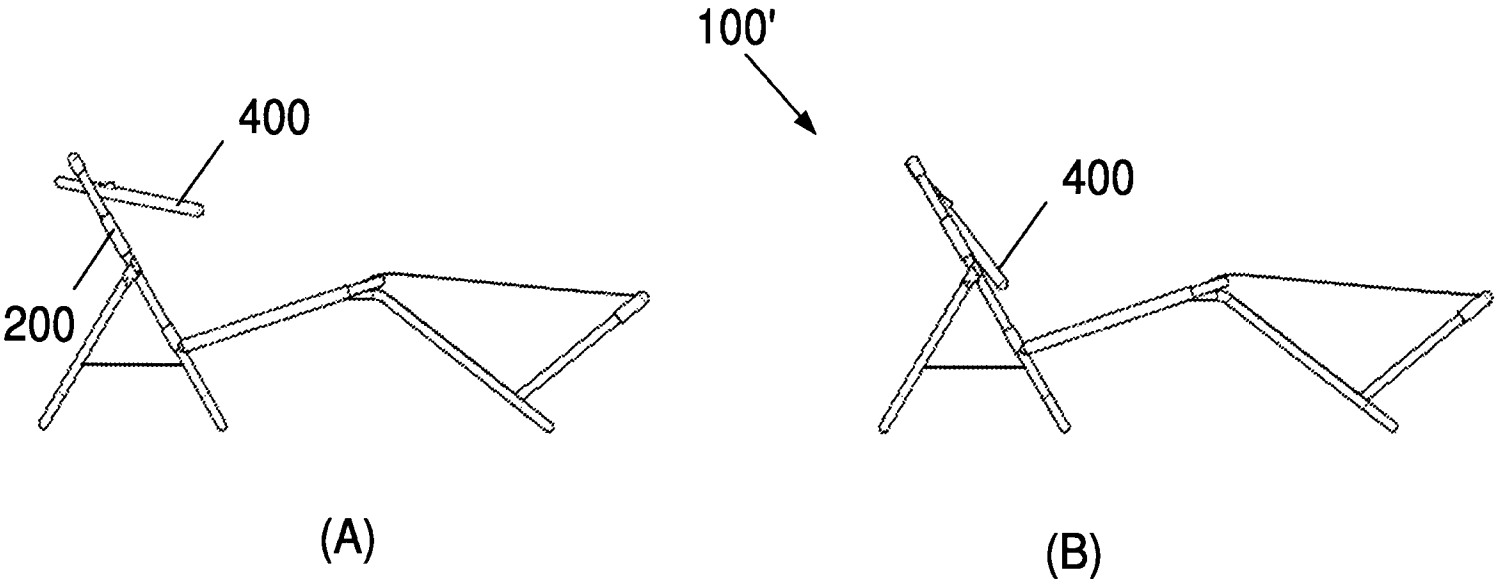
FIG. 5 shows side views of the collapsible beach chair of FIG. 4.

As can best be seen in FIG. 5, the head support 400 is pivotally mounted to the backrest frame 200 of the backrest 102.

Figure 6:
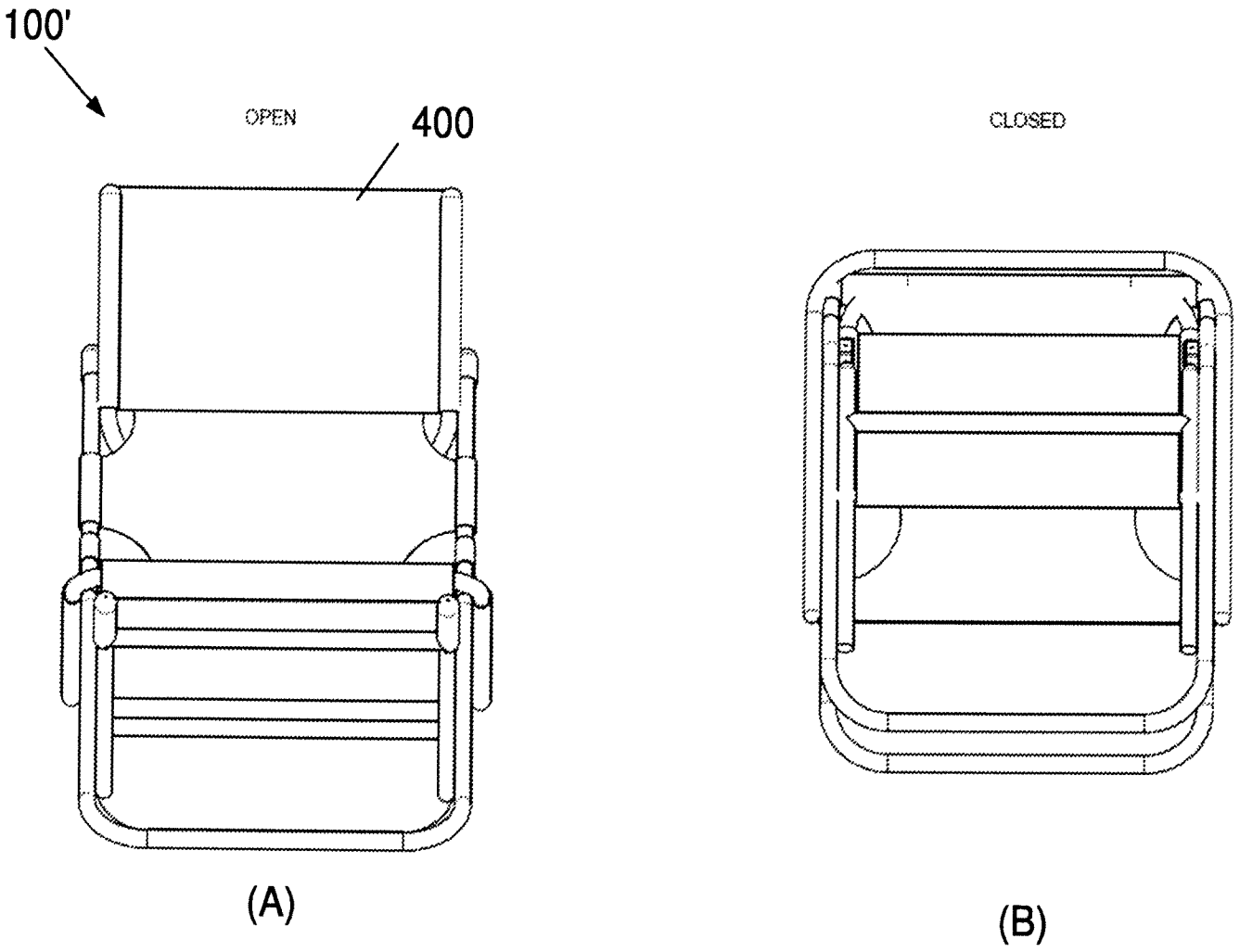
FIG. 6 is a plan view of the beach chair of FIG. 4 in an open and closed configuration.

FIG. 6 shows the beach chair 100' open, and closed or collapsed.

Figure 7:
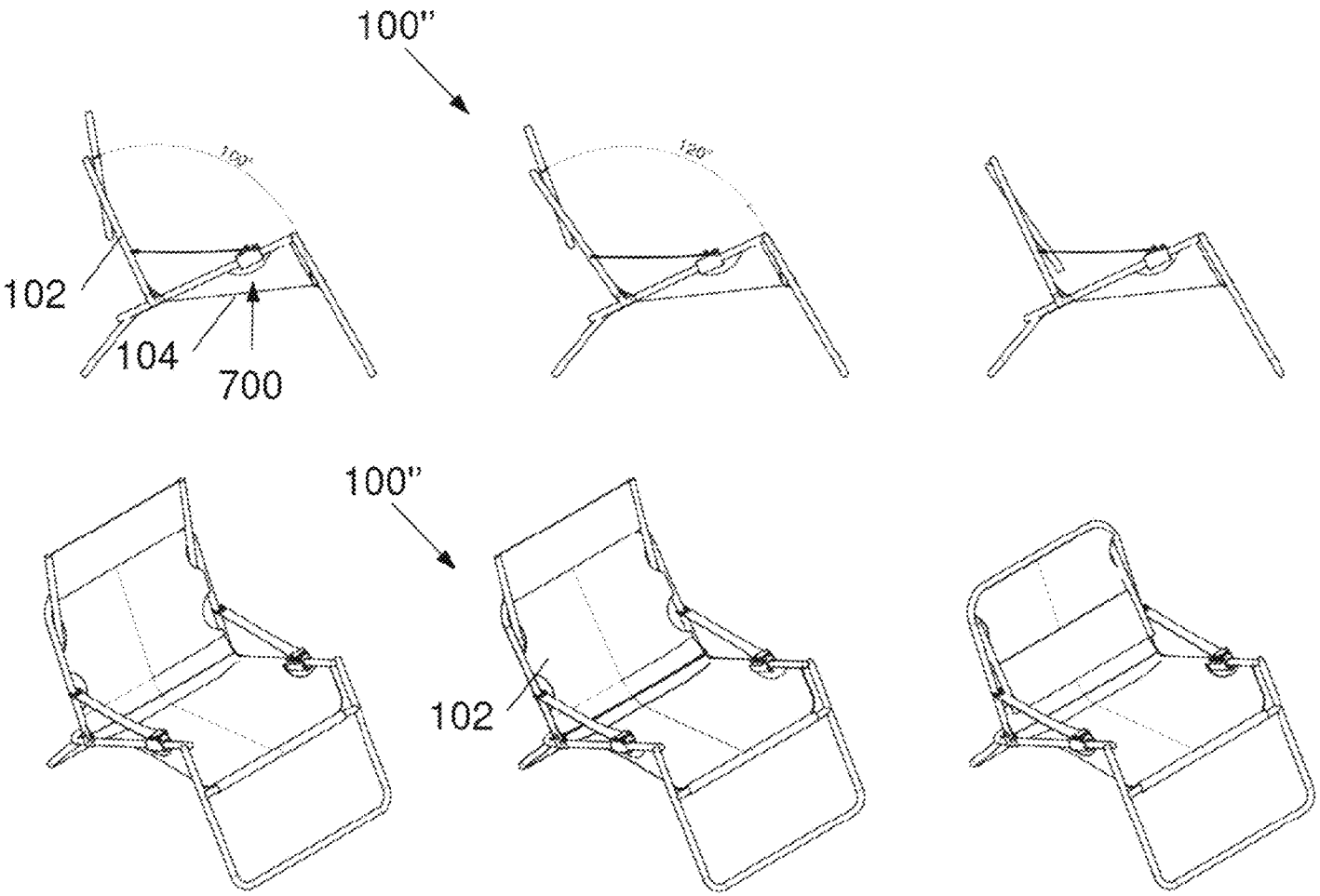
FIG. 7 shows side and perspective views of a collapsible beach chair with a recline adjuster.

FIG. 7 shows a collapsible beach chair 100" with a recline adjuster 700, and no leg support 106. The recline adjuster 700 is used to adjust the recline of the backrest 102 between 100° and 120° From the seat 104.

Figure 8:
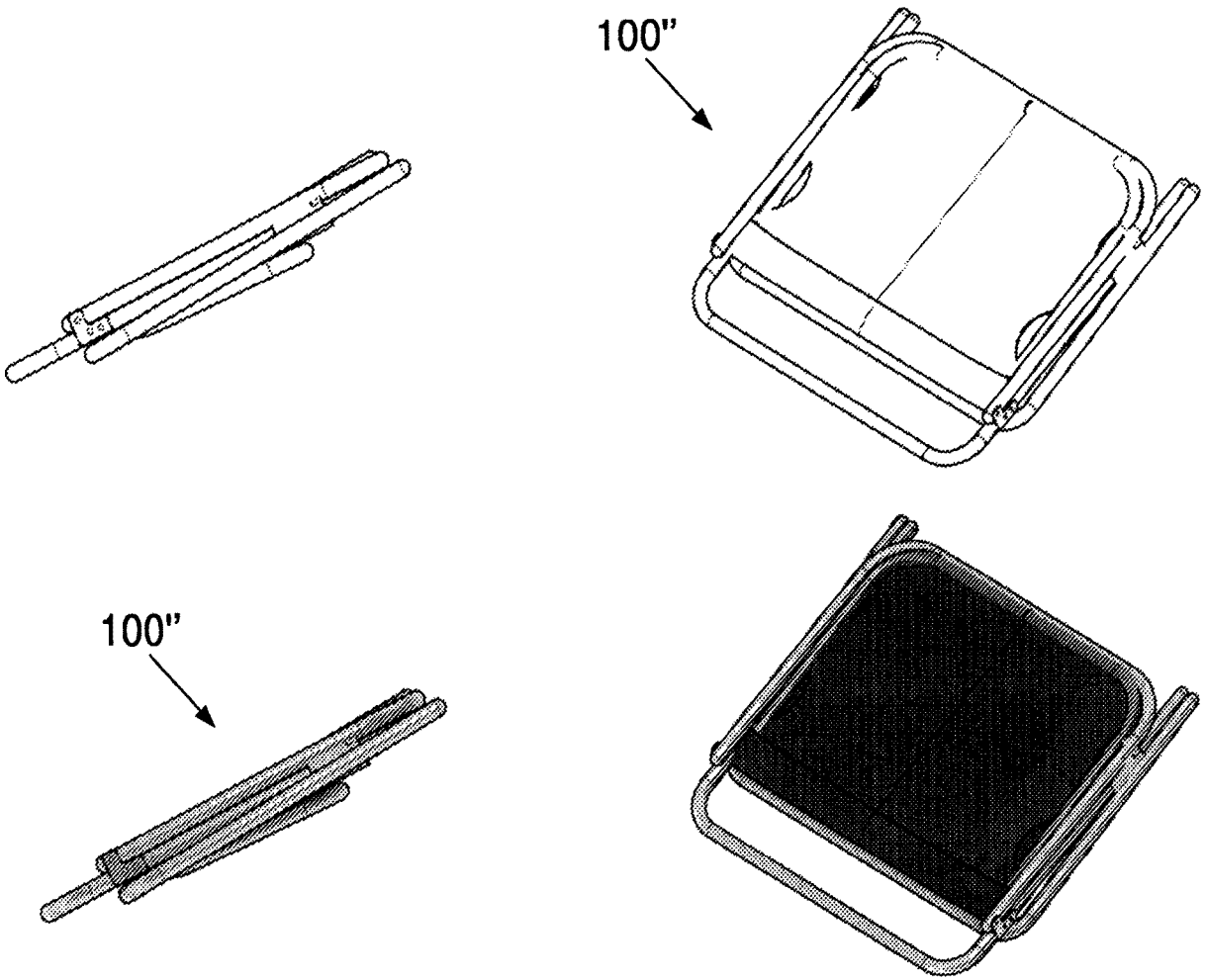
FIG. 8 shows side and perspective views of the collapsed beach chair of FIG. 7.

FIG. 8 shows the collapsed beach chair 100".

Figure 9:
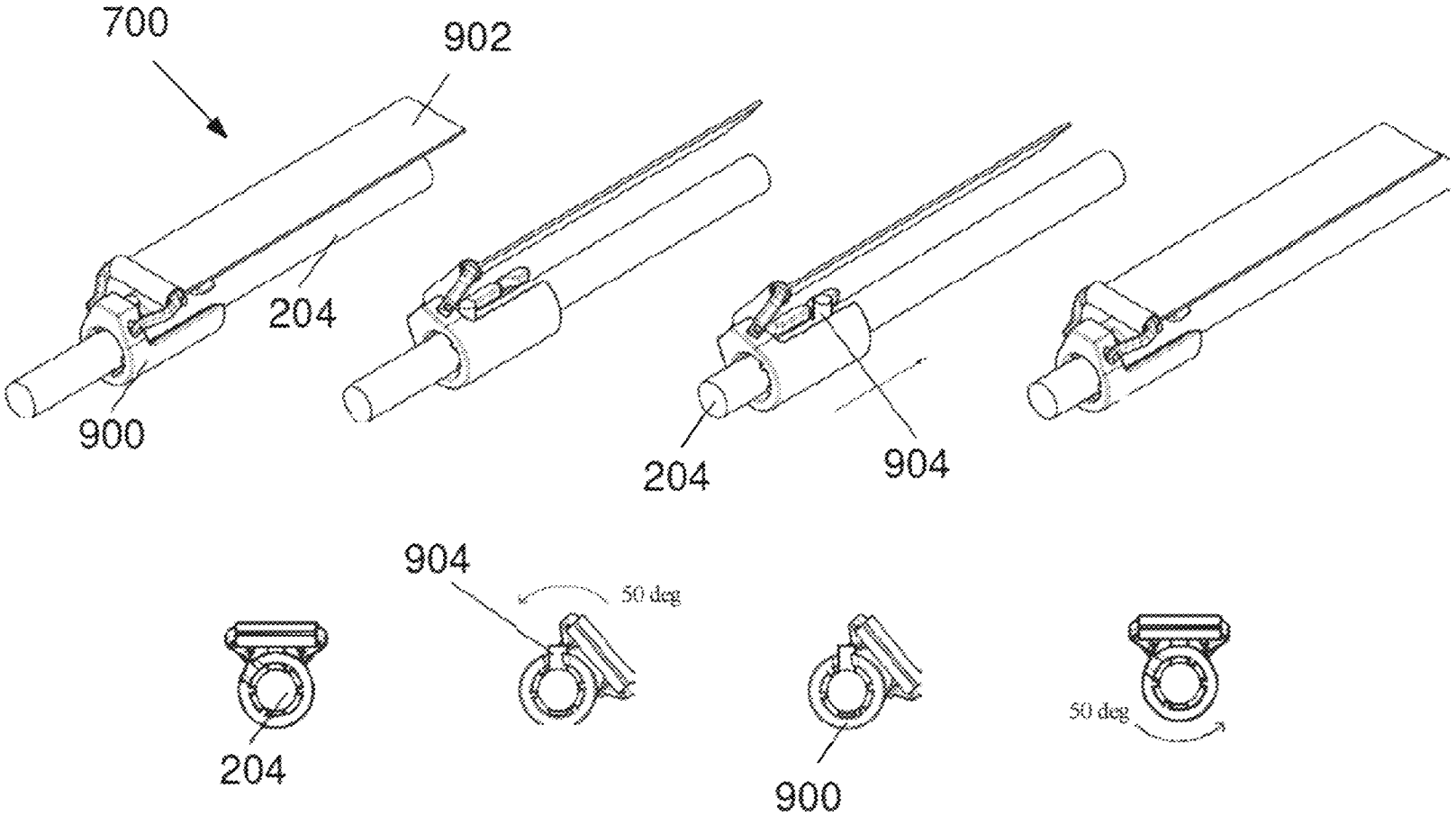
FIG. 9 shows perspective and end views of the recline adjuster of the chair of FIG. 7.

FIG. 9 shows the function of the recline adjuster 700. The recline adjuster 700 includes a tubular slider 900 for sliding along the seat frame 204 of the seat 104. A flaccid tether 902 is tethered between the slider 900 and the backrest 102, and is taught in use as shown in FIG. 7.

The recline adjuster 700 includes a lock for locking the slider 900 in place. The lock includes a tongue (or pin) 904 in groove arrangement. The lock is rotatably actuated, whereby the slider 900 is rotated and moved along the seat frame 204 until the backrest 102 reclines to a suitable position. The slider 900 is then rotated back so that the tongue 904 is received in one of the many grooves with which it is aligned, thus locking the slider 900 and backrest 102 in place.

A person skilled in the art will appreciate that many embodiments and variations can be made without departing from the ambit of the present invention.

In compliance with the statute, the invention has been described in language more or less specific to structural or methodical features. It is to be understood that the invention is not limited to specific features shown or described since the means herein described comprises preferred forms of putting the invention into effect.

Reference throughout this specification to 'one embodiment' or 'an embodiment' means that a particular feature, structure, or characteristic described in connection with the embodiment is included in at least one embodiment of the present invention. Thus, the appearance of the phrases 'in one embodiment' or 'in an embodiment' in various places throughout this specification are not necessarily all referring to the same embodiment. Furthermore, the particular features, structures, or characteristics may be combined in any suitable manner in one or more combinations.

The invention claimed is:

1. A collapsible chair including:

a backrest for engaging with a sitter's back;

a seat extending from the backrest and upon which the sitter can sit;

a front spur frame pivotally mounted to the seat opposite to the backrest, the front spur frame extending outwardly from the seat to a distal end region; and a retractable leg support extending from the seat and which is movable to be extended to support the sitter's legs with feet off the ground, the leg support including a U-shaped pivoting frame pivotally mounted to the distal end region of the front spur frame, the U-shaped pivoting frame configured to extend upwardly and outwardly from a base thereof to a distal end when the leg support is extended to support the sitter's legs;

wherein a proximal end region of the front spur frame is pivotally connected to the seat;

wherein the distal end region of the front spur frame contacts the ground when the sitter is supported by the seat wherein the backrest is provided by a backrest frame extending from a first end to a second end, wherein the second end contacts the ground when the sitter is supported by the seat; and wherein the chair further comprises a rear spur frame pivotally mounted to the backrest at an intermediate position between the first and second ends, wherein a distal end region of the rear spur frame contacts the ground when the sitter is supported by the seat.

2. A collapsible chair as claimed in claim 1, further including a retractable head support for supporting a sitter's head.

3. A collapsible chair as claimed in claim 2, wherein the head support is pivotally mounted to the backrest.

4. A collapsible chair as claimed in claim 1, further including a recline adjuster to adjust the recline of the backrest.

5. A collapsible chair as claimed in claim 4, wherein the recline adjuster includes a slider for sliding along the seat; and a tether for tethering between the slider and the backrest.

6. A collapsible chair as claimed in claim 5, wherein the recline adjuster includes a lock for locking the slider in place.

7. A collapsible chair as claimed in claim 6, wherein the lock includes a tongue in groove arrangement.

8. A collapsible chair as claimed in claim 6, wherein the lock is rotatably actuated.

9. A collapsible chair as claimed in claim 5, wherein the tether is flaccid when the collapsible chair is collapsed but becomes taut when the collapsible chair is extended in use.

10. A collapsible chair as claimed in claim 1, further including a collapsible chair frame, in turn, including frame elements that nest together so that when the collapsible chair frame is collapsed, the collapsible chair frame has a compact thickness of no more than three frame elements, wherein the U-shaped pivoting frame of the leg support is nested within the front spur frame when the collapsible chair frame is collapsed.

11. A collapsible chair as claimed in claim 10, wherein the collapsed thickness of the collapsible chair frame is less than 10 cm, and preferably about 6 cm; and wherein the collapsible chair frame, when folded has length and width dimensions of about 50 cm×60 cm.

12. A collapsible chair as claimed in claim 10, further including one or more sheet supports for mounting to the collapsible chair frame to support the sitter; and wherein the one or more sheet supports include one or more cutouts to facilitate frame folding.

13. A collapsible chair as claimed in claim 1, wherein the seat is provided by a seat frame pivotally mounted to the backrest frame.

14. A collapsible chair as claimed in claim 1, further including a storage area at the rear of the backrest; and wherein the storage area includes a shelf.

15. A collapsible chair as claimed in claim 1, weighing less than 2 kg.

16. A collapsible chair as claimed in claim 1, wherein the pivoting frame of the leg support is movable from a retracted position with the pivoting frame extending upwardly and the distal end adjacent to the proximal end region of the front spur frame so that the sitter's feet engage the ground, to an extended position with the pivoting frame extending upwardly and outwardly to the distal end to support the sitter's legs; and wherein the pivoting frame of the leg support is nested within the front spur frame in the retracted position.

17. A collapsible chair including:

a backrest frame defining a backrest for engaging with a sitter's back;

a seat frame pivotally mounting to the backrest frame and extending therefrom, the seat frame defining a seat upon which the sitter can sit;

a rear spur frame pivotally mounted to the backrest frame;

a front spur frame having a proximal end pivotally mounted to the seat frame opposite to the backrest frame, the front spur frame extending outwardly from the seat frame to a distal end; and a U-shaped leg support frame having first and second free ends connected by a cross member to form a rigid structure, each of the first and second free ends of the leg support frame pivotally mounted to the distal end of the front spur frame such that the leg support frame is rotatable between a first extended position and a second retracted position;

a sheet extending between the seat frame and the cross member of the leg support frame;

wherein, in the first extended position, the distal end of the front spur frame contacts the ground when the sitter is supported by the seat, and the leg support frame extends upwardly from the ground and outwardly away from the seat frame such that the cross member is spaced apart from the ground, the front spur frame, and the seat frame, with the cross member holding the sheet in tension to support the sitter's legs with feet off the ground; and wherein, in the second retracted position, the distal end of the front spur frame contacts the ground when the sitter is supported by the seat, and the leg support frame extends upwardly from the ground and inwardly towards the seat frame such that the cross member is spaced apart from the ground and is adjacent to the proximal end of the front spur frame and the seat frame, with the sheet member folded so that the sitter's feet engage the ground wherein the backrest frame extends from a first end to a second end, and wherein the second end contacts the ground when the sitter is supported by the seat; and wherein the rear spur frame is pivotally mounted to the backrest at an intermediate position between the first and second ends, wherein a distal end region of the rear spur frame contacts the ground when the sitter is supported by the seat.

18. The chair of claim 17 wherein the U-shaped leg support frame is nested within the front spur frame in the second retracted position;

wherein the U-shaped leg support frame pivots about an axis of rotation between the first extended position and the second retracted position; and wherein the cross member of the U-shaped leg support frame remains in an orientation parallel to the axis of rotation as the U-shaped leg support frame is rotated between the first extended position and the second retracted position.

* * * * *